US011841167B2

(12) United States Patent
Hu et al.

(10) Patent No.: US 11,841,167 B2
(45) Date of Patent: Dec. 12, 2023

(54) AIR CURTAIN DEVICE AND METHOD FOR MANUFACTURING THE SAME

(71) Applicant: National Taipei University of Technology, Taipei (TW)

(72) Inventors: Shih-Cheng Hu, Taipei (TW); Ti Lin, Taipei (TW)

(73) Assignee: National Taipei University of Technology, Taipei (TW)

( * ) Notice: Subject to any disclaimer, the term of this patent is extended or adjusted under 35 U.S.C. 154(b) by 276 days.

(21) Appl. No.: 17/386,318

(22) Filed: Jul. 27, 2021

(65) Prior Publication Data

US 2022/0034532 A1 Feb. 3, 2022

(30) Foreign Application Priority Data

Jul. 29, 2020 (TW) ..... 109125598

(51) Int. Cl.
*F24F 9/00* (2006.01)

(52) U.S. Cl.
CPC ..... *F24F 9/00* (2013.01); *F24F 2009/007* (2013.01)

(58) Field of Classification Search
CPC ..... F24F 9/00; F24F 2009/007; H01L 21/67; H01L 31/024; H01L 31/0521; H01L 23/34; H01L 24/00; H01L 21/02057; H01L 21/02082; H01L 21/67017; H01L 21/673; H01L 21/67772
USPC ..... 454/188
See application file for complete search history.

(56) References Cited

FOREIGN PATENT DOCUMENTS

| | | | | |
|---|---|---|---|---|
| CN | 204596758 U | * | 8/2015 | ..... H01L 21/67 |
| JP | 2002261159 A | * | 9/2002 | ..... H01L 21/67017 |
| JP | 3239604 U | * | 10/2022 | |
| TW | 520194 U | * | 4/2016 | ..... H01L 21/67 |
| TW | 107135885 | * | 10/2018 | ..... H01L 21/67 |
| TW | 202015196 A | | 4/2020 | |

OTHER PUBLICATIONS

Hu, Shih-Cheng, TWM520194 Translation.pdf, "Gas curtain structure", Apr. 2016, pp. 1-4.*
Hu, Shizheng, CN204596758 Translation.pdf, "Can produce device of gas curtain protective screen that flow equilizes", Aug. 2015, pp. 1-6.*
Search Report appended to an Office Action, which was issued to Taiwanese counterpart application No. 109125598 by the TIPO dated May 7, 2021, with an English translation thereof.

* cited by examiner

*Primary Examiner* — Avinash A Savani
*Assistant Examiner* — Ryan L Faulkner
(74) *Attorney, Agent, or Firm* — DLA PIPER LLP (US)

(57) ABSTRACT

A method for manufacturing an air curtain device includes steps of: a) providing a frame that includes two side wall bodies and two end wall bodies cooperatively defining an inner space thereamong, and an upper opening and a lower opening through which the inner space communicates with the external environment; b) covering an upper surface and a lateral outer surface of the frame with a first covering layer; c) closing the lower opening by placing an air-permeable plate; d) sealing a gap between the air-permeable plate and the frame by a first adhesive; e) removing a portion of the first covering layer that covers the upper surface of the frame; and f) closing the upper opening by a cover that is sealingly connected to the frame.

2 Claims, 15 Drawing Sheets

AIR CURTAIN DEVICE AND METHOD FOR MANUFACTURING THE SAME

CROSS-REFERENCE TO RELATED APPLICATION

This application claims priority to Taiwanese Invention Patent Application No. 109125598, filed on Jul. 29, 2020.

FIELD

The disclosure relates to an air curtain device and a method for manufacturing the same, and more particularly to an air curtain device from which air is prevented from leaking, and a method for manufacturing the same.

BACKGROUND

A conventional air curtain device includes a frame that has an upper opening and a lower opening spaced apart from each other in an up-down direction, a cover and an air-permeable plate. Specifically, the frame is formed by two side wall members that are spaced apart from each other, and two end wall members that interconnect the side wall members. The side wall members cooperate with the end wall members to define an inner space thereamong. The inner space communicates with the external environment through the upper opening and the lower opening. The cover and the air-permeable plate respectively cover the upper opening and the lower opening. When the conventional air curtain device is in operation, clean air is fed into the inner space to increase air pressure in the conventional air curtain device. When the air pressure is high enough, the conventional air curtain device produces a laminar airflow.

However, in a conventional method for manufacturing the conventional air curtain device, each of the end wall members is connected to the side wall members only by an adhesive, and the air-permeable plate is adhered to each of the end wall members and the side wall members to cover the lower opening by the adhesive as well. Consequently, the air pressure in the conventional air curtain device that the frame can withstand may be relatively low, which may easily cause air leakage through the frame. With the conventional method, strength of the frame can only be increased by applying more adhesive, and the adhesive may be likely to be over-applied. When the adhesive is over-applied during the assembling of the frame and the air-permeable plate, appearance of the conventional air curtain device may be affected, and the subsequent assembly of the frame and the cover may not be well-executed due to the excessive adhesive used.

SUMMARY

Therefore, an object of the disclosure is to provide a method for manufacturing an air curtain device that can alleviate at least one of the drawbacks of the prior art.

According to the disclosure, the method for manufacturing the air curtain device includes steps of: a) providing a frame that includes two side wall bodies spaced apart from each other, and two end wall bodies interconnecting the side wall bodies and cooperating with the side wall bodies to define an inner space thereamong, upper edges of the side wall bodies and the end wall bodies cooperatively forming a first connecting section, lower edges of the side wall bodies and the end wall bodies cooperatively forming a second connecting section, the first connecting section and the second connecting section respectively defining an upper opening and a lower opening through which the inner space communicates with the external environment; b) covering an upper surface and a lateral outer surface of each of the side wall bodies and the end wall bodies with a first covering layer; c) closing the lower opening of the frame by placing an air-permeable plate that abuts against a surface of the second connecting section facing the inner space, the air-permeable plate having a plurality of pores to thereby be air permeable; d) sealing a gap between the air-permeable plate and the second connecting section of the frame by a first adhesive; e) removing a portion of the first covering layer that covers the upper surface of each of the side wall bodies and the end wall bodies; and f) closing the upper opening of the frame by a cover that is sealingly connected to the first connecting section of the frame.

Another object of the disclosure is to provide an air curtain device that can alleviate at least one of the drawbacks of the prior art.

According to the disclosure, the air curtain device includes a frame, an air-permeable plate, a cover, a first adhesive and at least one gas fitting. The frame includes two side wall bodies and two end wall bodies. The side wall bodies are spaced apart from each other. The end wall bodies interconnect the side wall bodies, and cooperate with the side wall bodies to define an inner space thereamong. Upper edges of the side wall bodies and the end wall bodies cooperatively form a first connecting section. Lower edges of the side wall bodies and the end wall bodies cooperatively form a second connecting section. The first connecting section and the second connecting section respectively define an upper opening and a lower opening through which the inner space communicates with the external environment. The frame is formed by a base frame member having a base protruding part that surrounds the inner space and that protrudes upwardly, and a plurality of plate members. Each of the plate members is indented with abase-connecting recess, is located over the base frame member, and is coupled to the base protruding part by the base-connecting recess thereof. The base frame member and the plate members cooperatively define the side wall bodies and the end wall bodies. The air-permeable plate abuts against a surface of the second connecting section of the frame facing the inner space, and closes the lower opening. The air-permeable plate has a plurality of pores to thereby be air permeable. The cover is sealingly connected to the first connecting section of the frame to thereby close the upper opening of the frame. One of the frame and the cover is formed with at least one inlet opening through which the inner space of the frame communicates with the external environment. The first adhesive is applied to a gap between the air-permeable plate and the second connecting section of the frame, to a junction between the base frame member and each of the plate members, and to a junction between any adjacent ones of the plate members. The at least one gas fitting is connected to the at least one inlet opening of the one of the frame and the cover.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
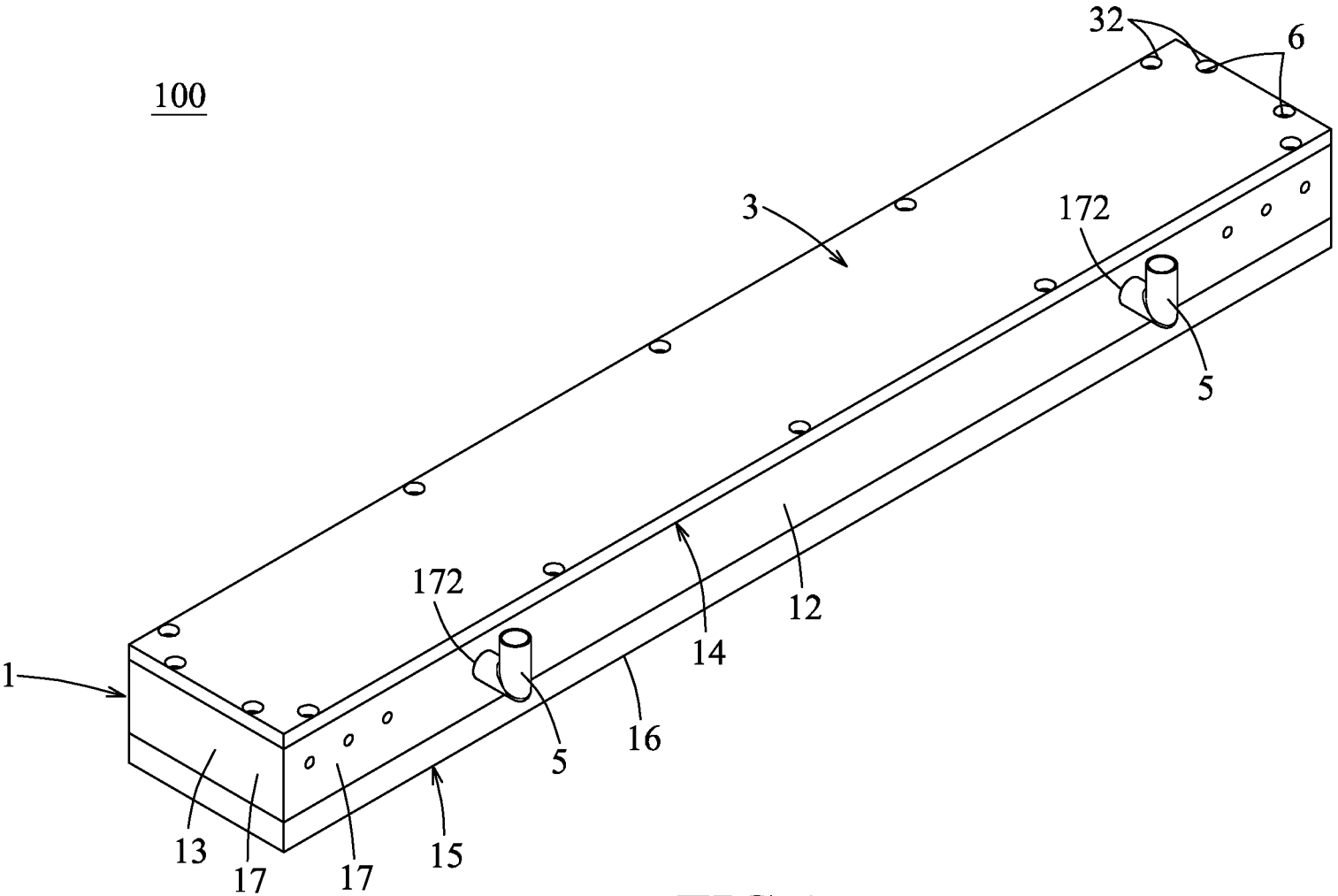
FIG. 1 is a perspective view of an embodiment of an air curtain device according to the disclosure.
Figure 2:
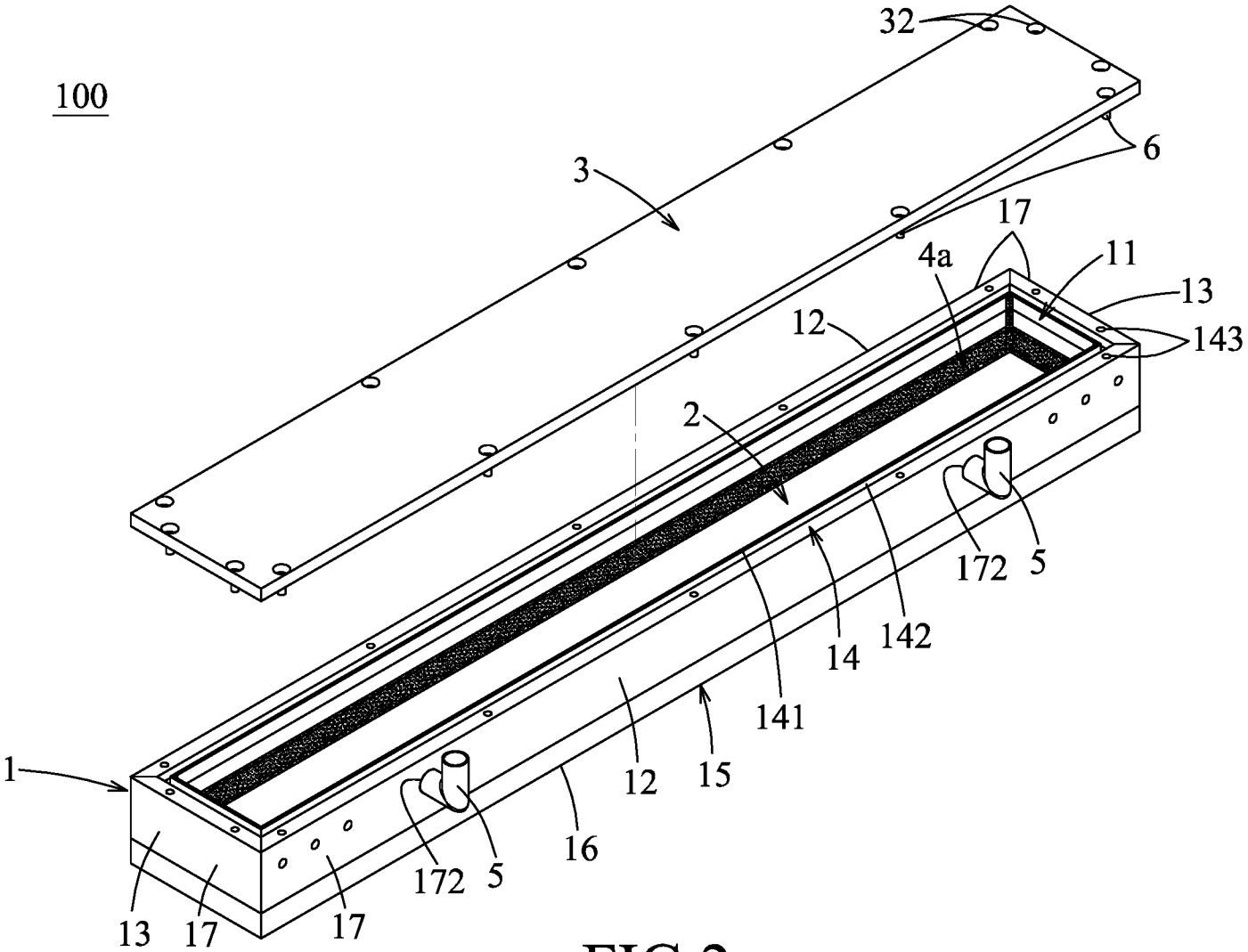
FIG. 2 is a partly exploded perspective view of the embodiment.
Figure 3:
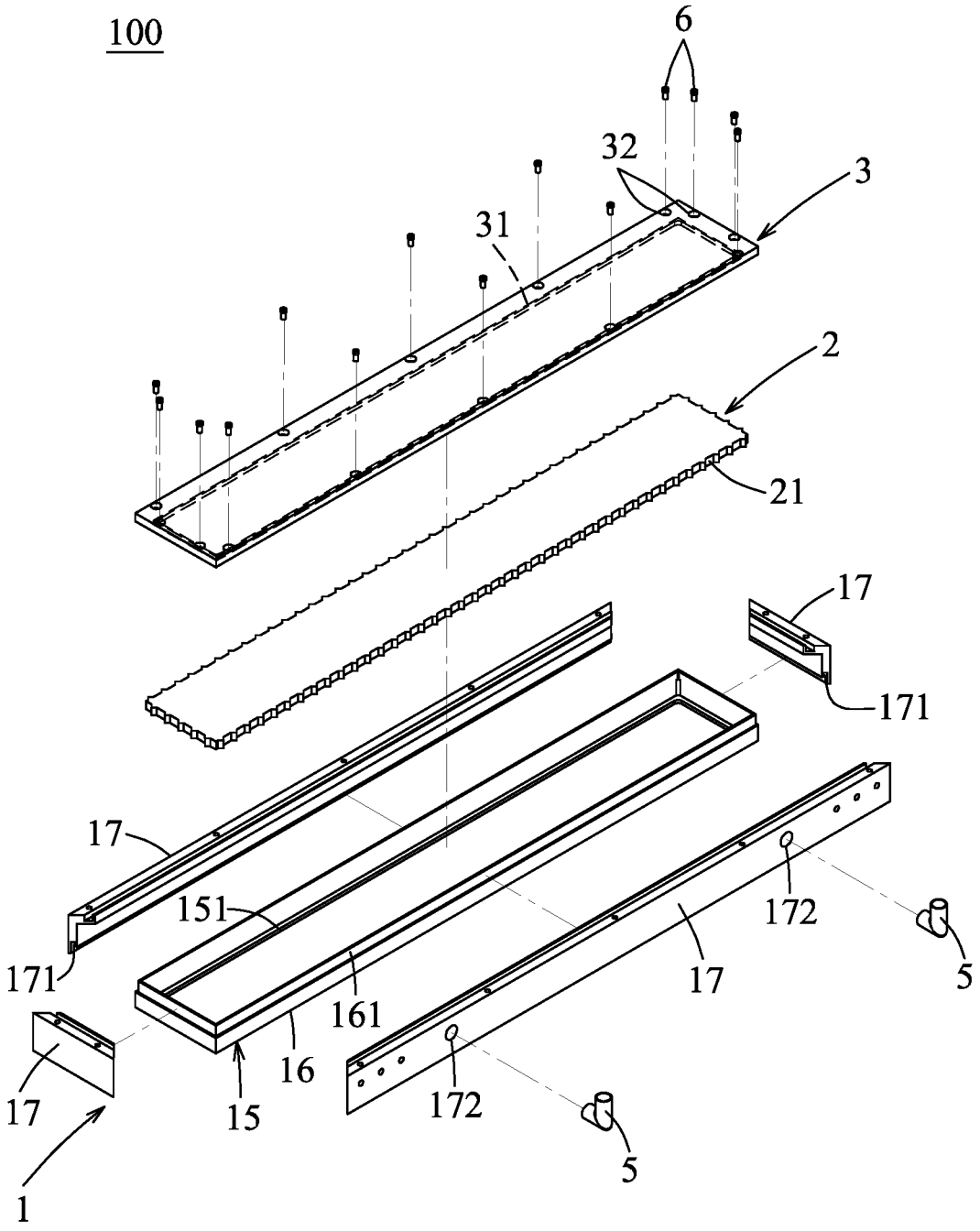
FIG. 3 is an exploded perspective view of the embodiment.
Figure 4:
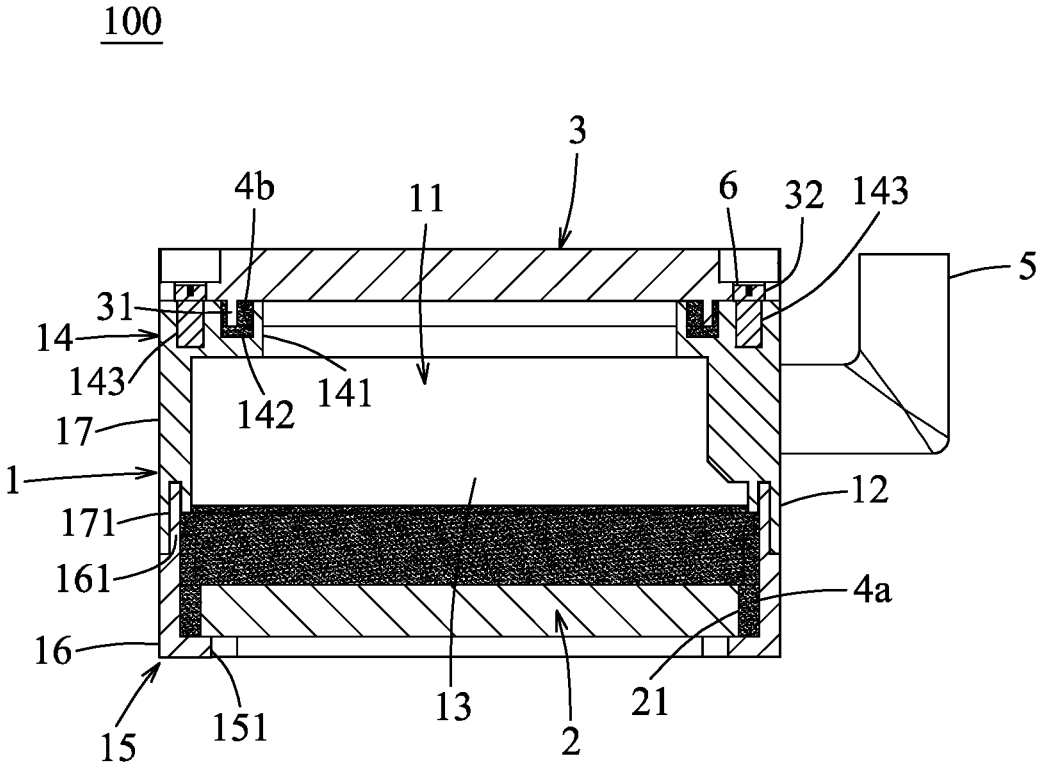
FIG. 4 is a sectional view of the embodiment.

Before the disclosure is described in greater detail, it should be noted that, directional terms, such as "vertical," "horizontal," "upper," "lower," "inner," "inwardly," "outer," "outwardly," "front," "rear," "left," "right," "top" and "bottom," may be used to assist in describing the disclosure based on the orientation of the embodiment shown in the illustrations. The use of these directional definitions should not be interpreted to limit the disclosure in any way.

Referring to FIGS. 1 to 4, an embodiment of an air curtain device 100 according to the disclosure includes a frame 1, an air-permeable plate 2, a cover 3, a first adhesive 4*a*, a second adhesive 4*b*, two gas fittings 5 and a plurality of screwing members 6.

The frame 1 includes two side wall bodies 12 and two end wall bodies 13. The side wall bodies 12 are spaced apart from each other. The end wall bodies 13 interconnect the side wall bodies 12 and cooperate with the side wall bodies 12 to define an inner space 11 thereamong. Upper edges of the side wall bodies 12 and the end wall bodies 13 cooperatively form a first connecting section 14 extending inwardly. Lower edges of the side wall bodies 12 and the end wall bodies 13 cooperatively form a second connecting section 15 extending inwardly. The first connecting section 14 and the second connecting section 15 respectively define an upper opening 141 and a lower opening 151 through which the inner space 11 communicates with the external environment. Each of the side wall bodies 12 and the end wall bodies 13 has an upper surface and a lateral outer surface that are opposite to (i.e., that face away from) the inner space 11. The upper surfaces of the side wall bodies 12 and the end wall bodies 13 cooperatively form an upper surface of the first connecting section 14 that is opposite to the inner space 11. Specifically, in this embodiment, the frame 1 is formed by an annular base frame member 16 and a plurality of plate members 17. The base frame member 16 has a base protruding part 161 surrounding the inner space 11 and protruding upwardly. Each of the plate members 17 is indented with a base-connecting recess 171, is located over the base frame member 16, and is coupled to the base protruding part 161 by the base-connecting recess 171 thereof. Adjacent ones of the plate members 17 are connected to each other. The base frame member 16 and the plate members 17 cooperatively define the side wall bodies 12 and the end wall bodies 13. It is noted that, in this embodiment, the frame 1 is formed by four plate members 17. Two of the plate members 17 cooperate with the base frame member 16 to respectively define the side wall bodies 12, and the other two of the plate members 17 cooperate with the base frame member 16 to respectively define the end wall bodies 13. However, in certain embodiments, the frame 1 may be formed by, but not limited to, two plate members 17. In one embodiment where the frame 1 is formed by two plate members 17, one of the plate members 17 may cooperate with the base frame member 16 to define the end wall bodies 13 and one of the side wall bodies 12, and the other one of the plate members 17 may cooperate with the base frame member 16 to define the other one of the side wall bodies 12. The configurations of the base frame member 16 and the plate members 17 are not limited to those mentioned above. Moreover, the base frame member 16 and the plate members 17 may be integrated into a single piece.

The air-permeable plate 2 abuts against a surface of the second connecting section 15 of the frame 1 facing the inner space 11, and closes the lower opening 151 of the frame 1. The air-permeable plate 2 has a plurality of pores 22 (not shown) to thereby be air permeable. Specifically, the thickness of the air-permeable plate 2 ranges from 3 to 10 millimeters. The air-permeable plate 2 may be made from a sintered polymer material that is hydrophobic and that has moisture absorption of less than 5% (by mass). The sintered polymer material may be ultra-high-molecular-weight polyethylene (UHMWPE) that is resistant to corrosion and chemicals, and that has relatively high toughness, high impact resistance, low coefficient of friction and low moisture absorption among thermoplastic materials. Furthermore, the diameter of each of the pores 22 ranges from 0.01 to 100 micrometers. In one embodiment, the thickness of the air-permeable plate is 5 millimeters.

The cover 3 is sealingly connected to the first connecting section 14 of the frame 1 to thereby close the upper opening 141 of the frame 1. Specifically, the first connecting section 14 of the frame 1 is indented with a groove 142 surrounding the upper opening 141 of the frame 1, and is formed with a plurality of threaded holes 143. The cover 3 has an annular protrusion 31 protruding from a bottom surface thereof and coupled to the groove 142, is formed with a plurality of through holes 32 respectively corresponding in position to the threaded holes 143, and has a lateral surrounding surface surrounding the through holes 32.

The first adhesive 4*a* is applied to a gap between the air-permeable plate 2 and the second connecting section 15 of the frame 1, to a junction between the base frame member 16 of the frame 1 and each of the plate members 17 of the frame 1, and to a junction between any adjacent ones of the plate members 17. Preferably, the first adhesive 4*a* is applied to an inner side of each of the side wall bodies 12 and the end wall bodies 13 opposite to the lateral outer surface thereof. The second adhesive 4*b* is applied to the groove 142 of the first connecting section 14 of the frame 1. The screwing members 6 respectively extend through the through holes 32 of the cover 3, and respectively and threadedly engage the threaded holes 143 of the first connecting section 14, so that the cover 3 and the first connecting section 14 are sealingly connected by the second adhesive 4*b* and the upper opening 141 of the frame 1 is closed.

In this embodiment, one of the plate members 17 of the frame 1 is formed with two inlet openings 172 through which the inner space 11 of the frame 1 communicates with the external environment. The gas fittings 5 are respectively connected to the inlet openings 172. It is noted that, in certain embodiments, the frame 1 may be formed with only one inlet opening 172, or more than two inlet openings 172, and the air curtain device 100 may include only one gas fitting 5, or more than two gas fittings 5. The location of the frame 1 at which the inlet opening 172 is formed is not limited. In addition, in certain embodiments, the inlet opening 172 may be formed at the cover 3.

When the air curtain device 100 is in operation, clean air (e.g., compressed dry air (CDA) or noble gases) is fed into the inner space 11 of the frame 1 through the gas fittings 5. Because of the small diameter of the pores 22, the clean air is not able to flow through the air-permeable plate 2 until the air pressure in the inner space 11 is high enough. When the increasing air pressure reaches the maximum static pressure, the pressure difference between the inner space 11 and the external environment urges the clean air to flow downwardly through the pores 22 of the air-permeable plate 2. Therefore, a uniform air stream (i.e., an air curtain) (not shown) is generated. By virtue of the first adhesive 4*a* and the second adhesive 4*b*, the clean air is prevented from leaking out of the air curtain device 100 through the junctions between the frame 1 and the air-permeable plate 2, between the frame 1 and the cover 3, and between the frame 1 and each of the gas fittings 5. The air-permeable plate 2 further has a zigzag-shaped structure 21 (see FIG. 3) at an edge thereof. The zigzag-shaped structure 21 has serrations substantially forming a zigzag pattern. The air-permeable plate 2 abuts against the surface of the second connecting section 15 facing the inner space 11 with the zigzag-shaped structure 21 thereof when the first adhesive 4*a* is applied to the gap between the air-permeable plate 2 and the second connecting section 15. By virtue of the serrations of the zigzag-shaped structure 21, the area of contact between the first adhesive 4*a* and the air-permeable plate 2 is larger than that between the first adhesive 4*a* and an air-permeable plate with a uniformly straight edge, so that the air-permeable plate 2 is firmly connected to the frame 1 by the first adhesive 4*a* with an airtight fit. Moreover, in addition to the connection formed by the first adhesive 4*a*, the plate members 17 are each coupled to the base frame member 16 to cooperatively define the side wall bodies 12 and the end wall bodies 13 of the frame 1. The coupling strengthens the frame 1 and prevents the clean air from leaking out of the air curtain device 100 through the frame 1.

Figure 5A:
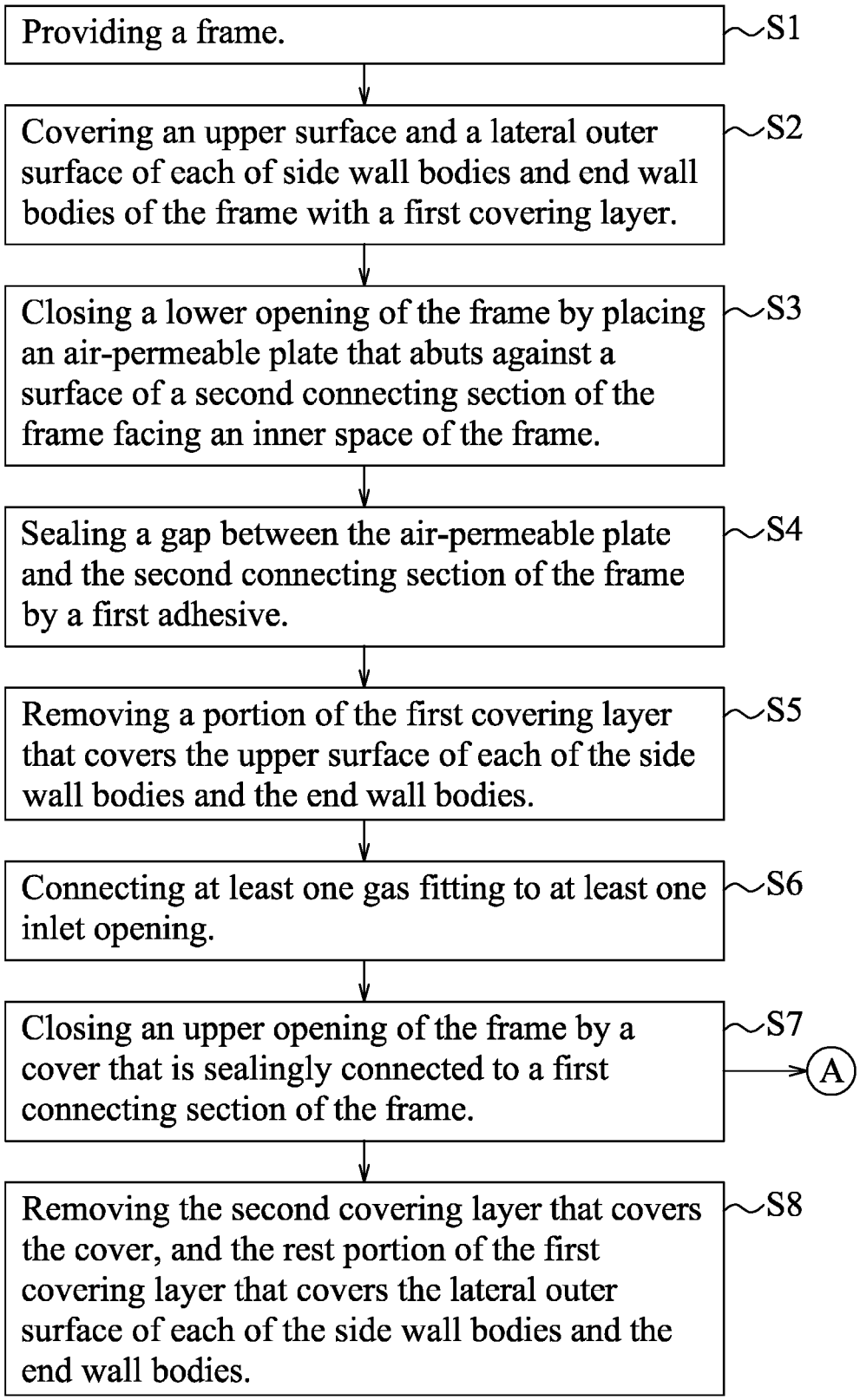
FIGS. 5A and 5B are a flow diagram illustrating an embodiment of a method for manufacturing the embodiment of the air curtain device according to the disclosure.
Figure 5B:
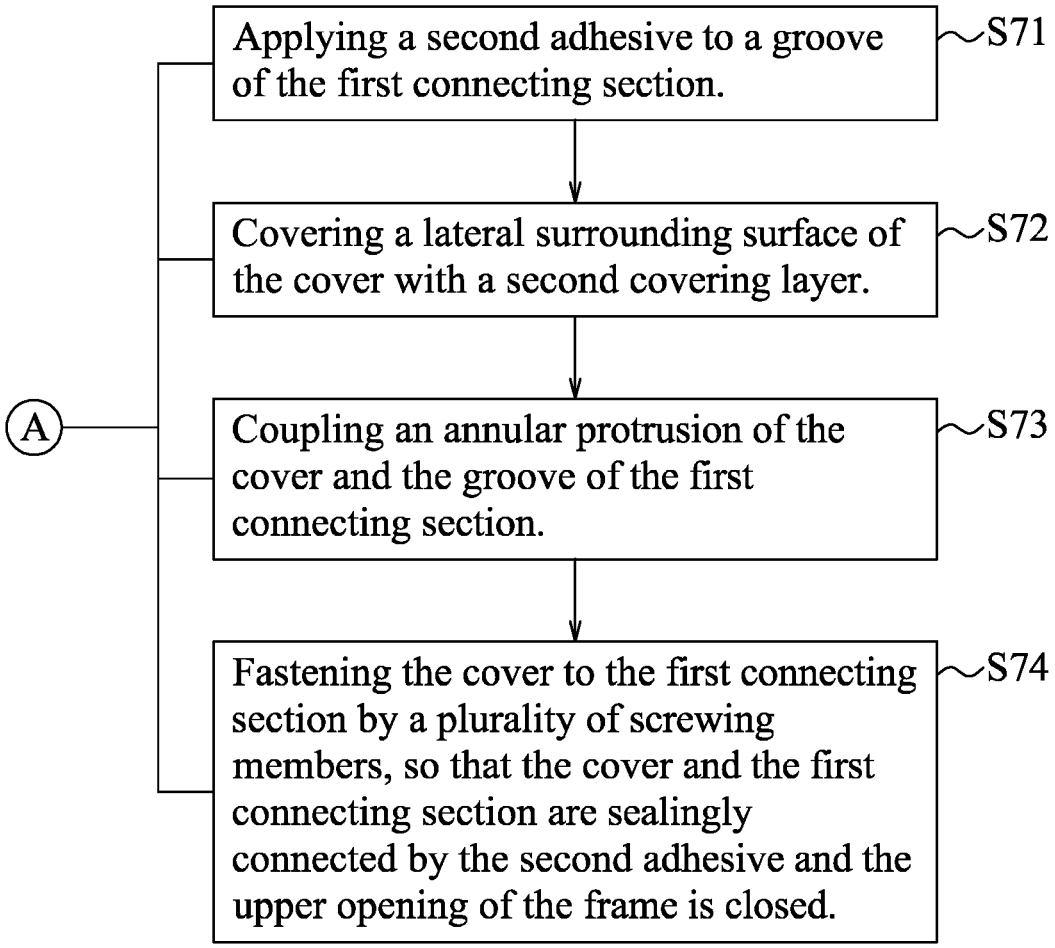
Figure 6:
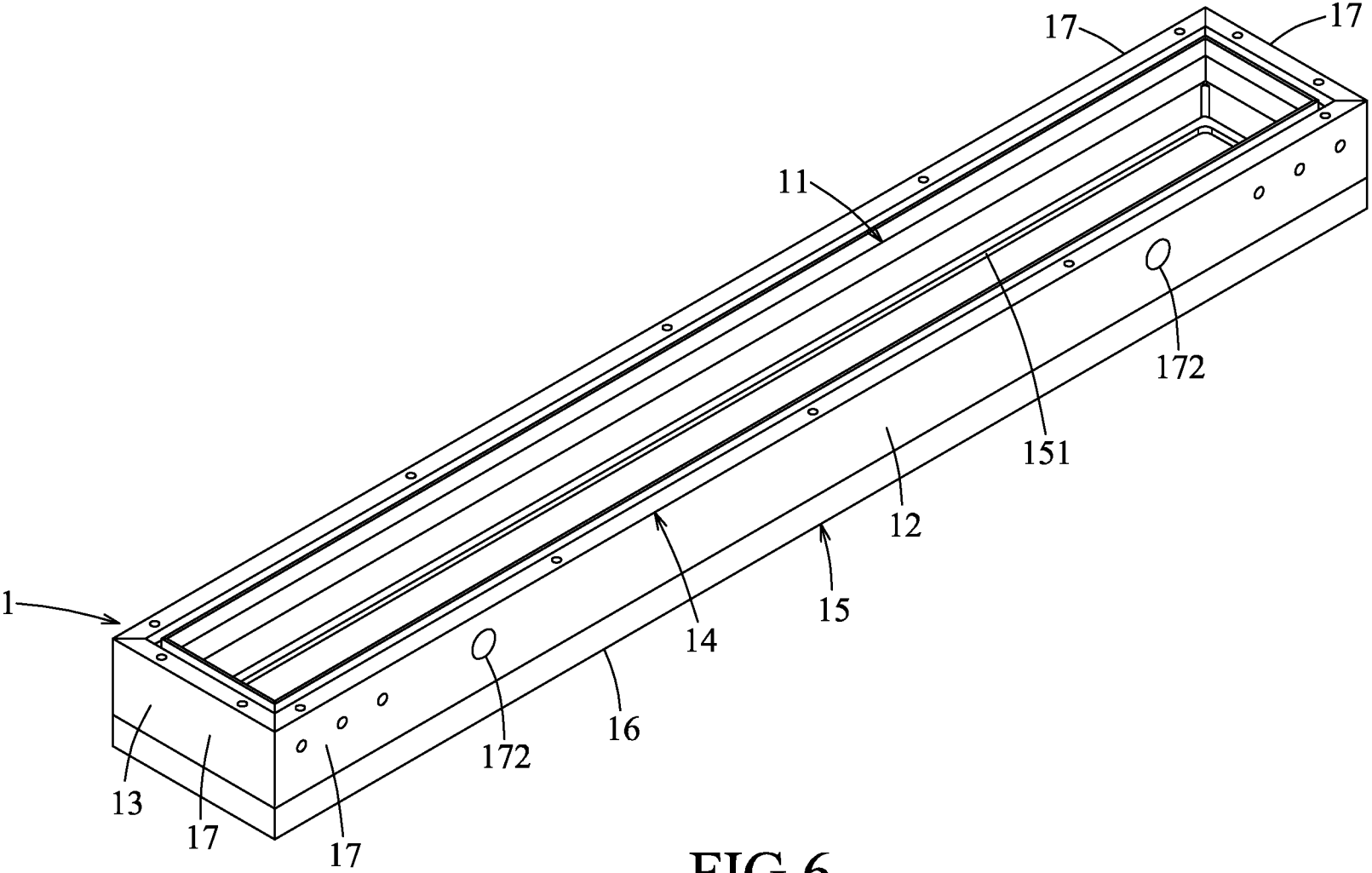
FIG. 6 is a perspective view of a frame provided in step S1 of the embodiment in FIG. 5A.

Referring to FIGS. 5A and 5B, an embodiment of a method for manufacturing an air curtain device 100 according to the disclosure includes steps S1 to S8. Referring further to FIG. 6, in step S1, the frame 1 is provided.

Figure 7:
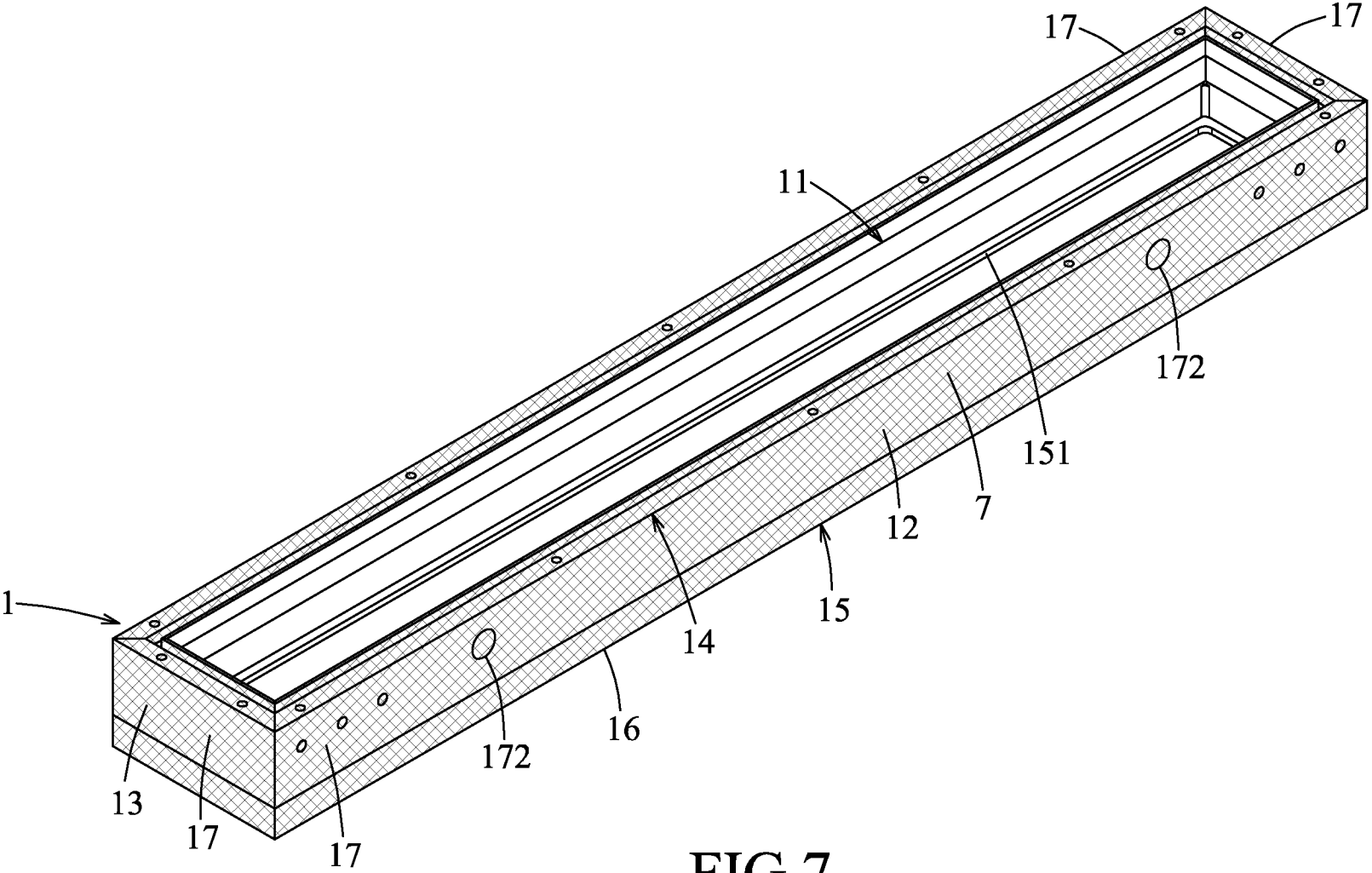
FIG. 7 is a perspective view illustrating execution of step S2 of the embodiment in FIG. 5A.

Referring further to FIG. 7, in executing step S2, the upper surface and the lateral outer surface of each of the side wall bodies 12 and the end wall bodies 13 of the frame 1 are covered with a first covering layer 7. Specifically, the first covering layer 7 may be a masking tape. In this embodiment of the method, the first covering layer 7 completely covers the upper surfaces and the lateral outer surfaces of the side wall bodies 12 and the end wall bodies 13, and the groove 142 of the first connecting section 14 of the frame 1, but in certain embodiments, the first covering layer 7 may only cover a portion of the upper surfaces and the lateral outer surfaces from which the excess first adhesive 4*a* is more likely to come out when the first adhesive 4*a* is accidentally over-applied.

Figure 8:
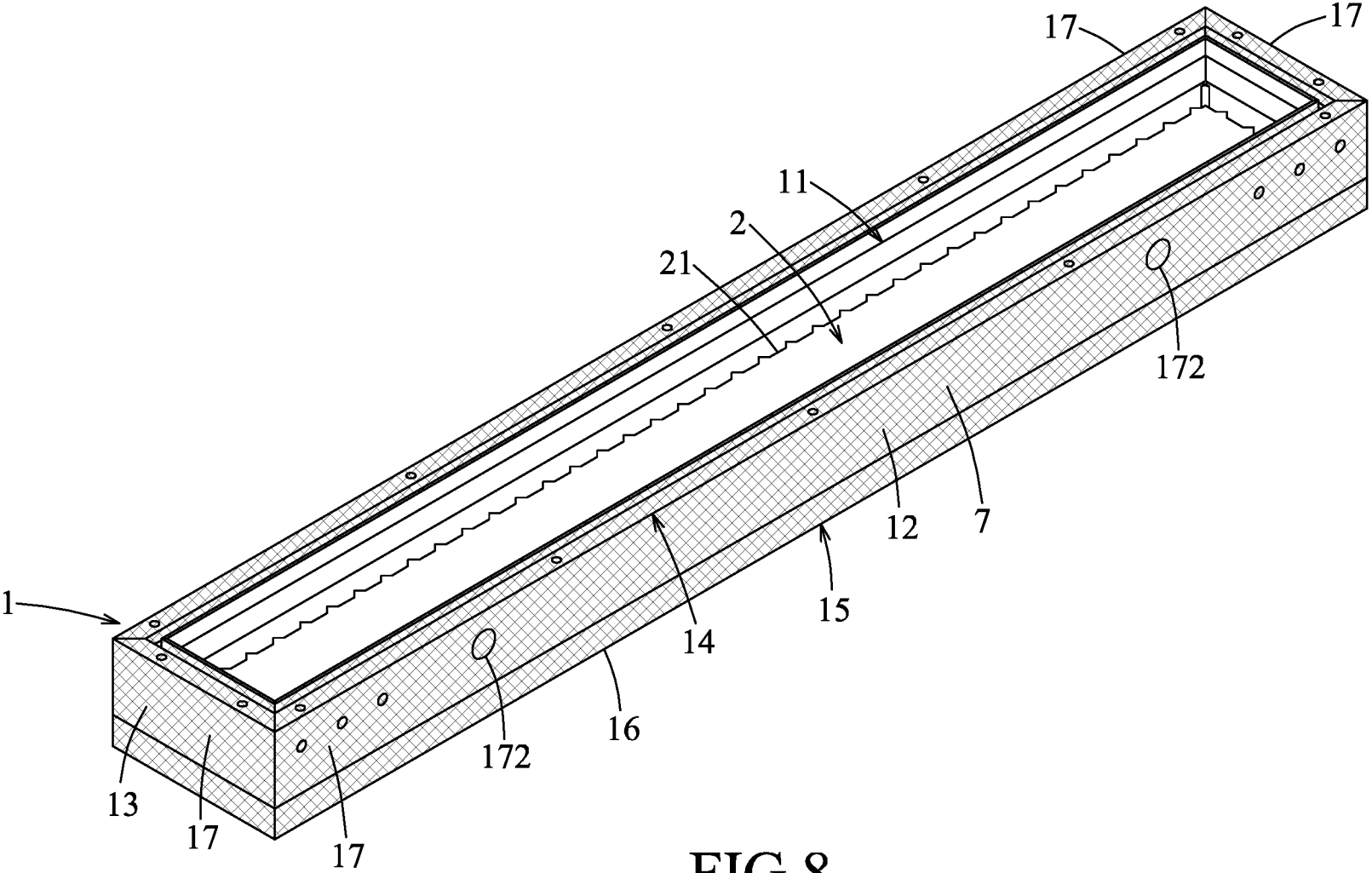
FIG. 8 is a perspective view illustrating execution of step S3 of the embodiment in FIG. 5A.

Referring further to FIG. 8, in executing step S3, the air-permeable plate 2 is placed in the inner space 11 of the frame 1 to close the lower opening 151 (see FIG. 2) of the frame 1.

Figure 9:
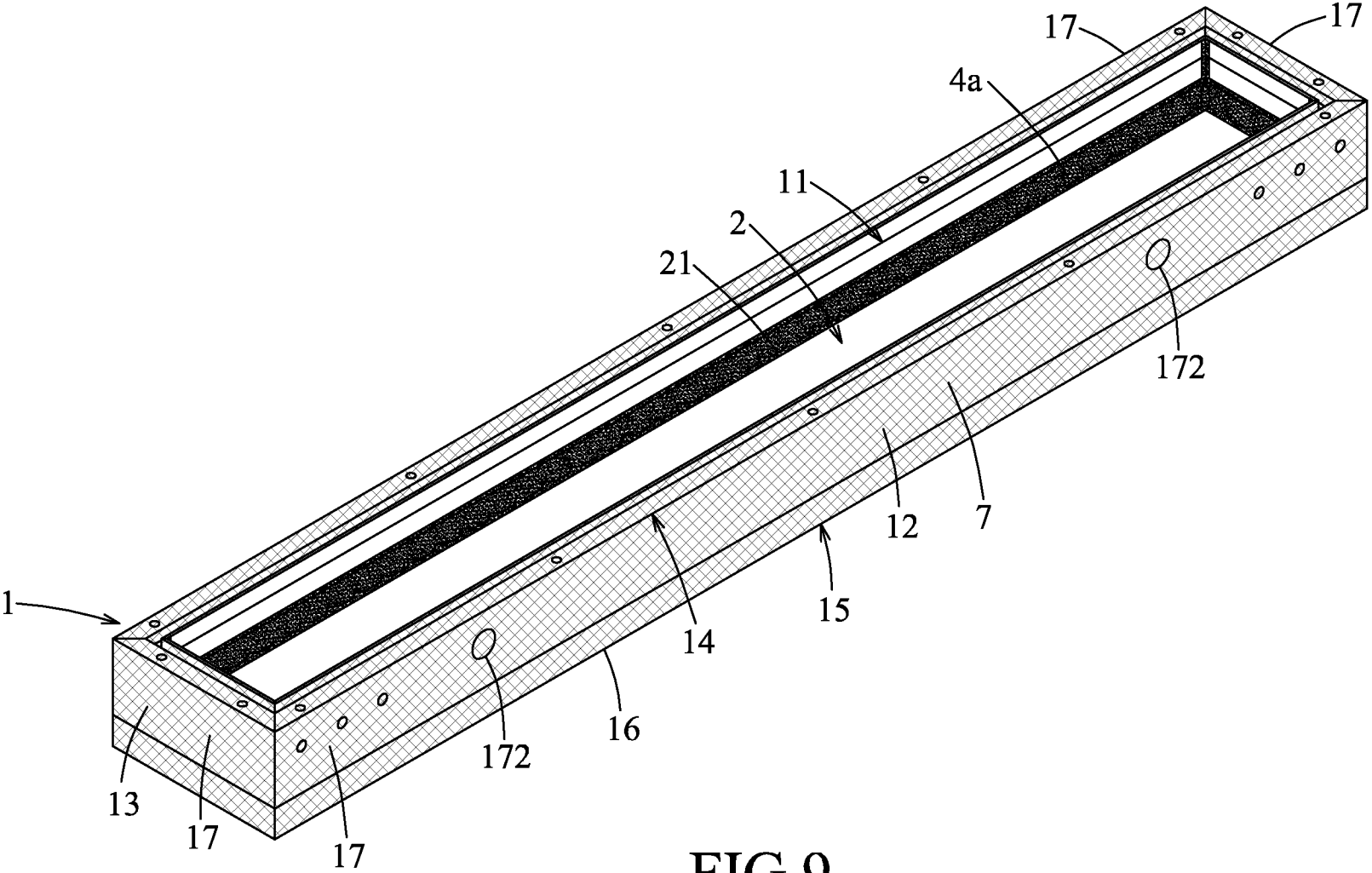
FIG. 9 is a perspective view illustrating execution of step S4 of the embodiment in FIG. 5A.

Referring further to FIG. 9, in executing step S4, the gap between the air-permeable plate 2 and the second connecting section 15 of the frame 1 is sealed by the first adhesive 4*a*. In this embodiment, the junction between the base frame member 16 of the frame 1 and each of the plate members 17 of the frame 1, and the junction between any adjacent ones of the plate members 17 are sealed by the first adhesive 4*a* as well. In addition, a fixture (not shown) that holds the base frame member 16 and the plate members 17, by clamping the first connecting section 14 and the second connecting section 15 of the frame 1, may be deployed before the application of the first adhesive 4*a* to facilitate the application. It is noted that, for certain embodiments in which the base frame member 16 and the plate members 17 are integrated as one piece, the first adhesive 4*a* is only applied to the gap between the air-permeable plate 2 and the second connecting section 15.

Figure 10:
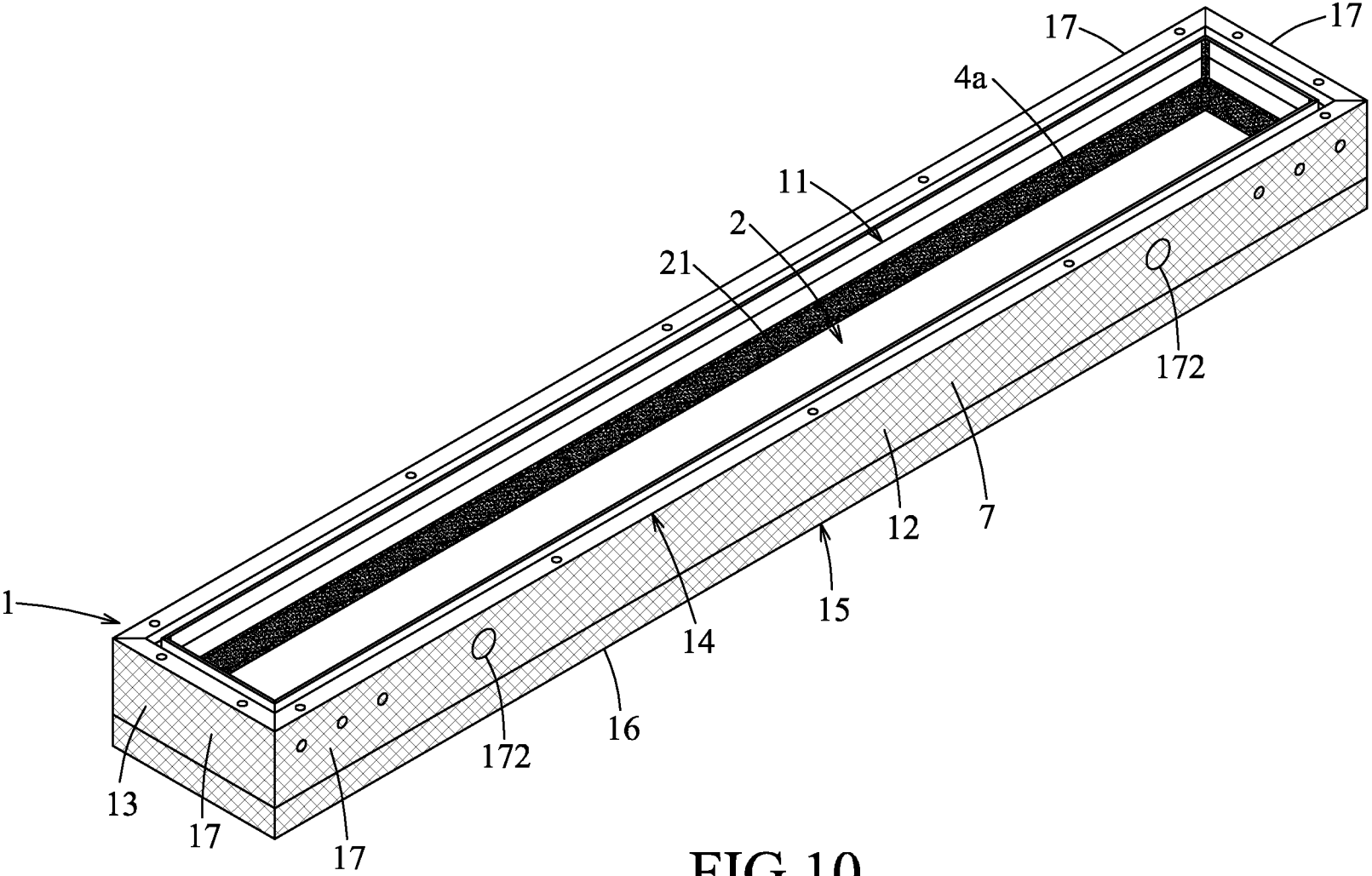
FIG. 10 is a perspective view illustrating execution of step S5 of the embodiment in FIG. 5A.

Referring further to FIG. 10, in executing step S5, a portion of the first covering layer 7 that covers the upper surface of each of the side wall bodies 12 and the end wall bodies 13, and a portion of the first covering layer 7 that covers the groove 142 of the first connecting section 14 of the frame 1 are removed.

Figure 11:
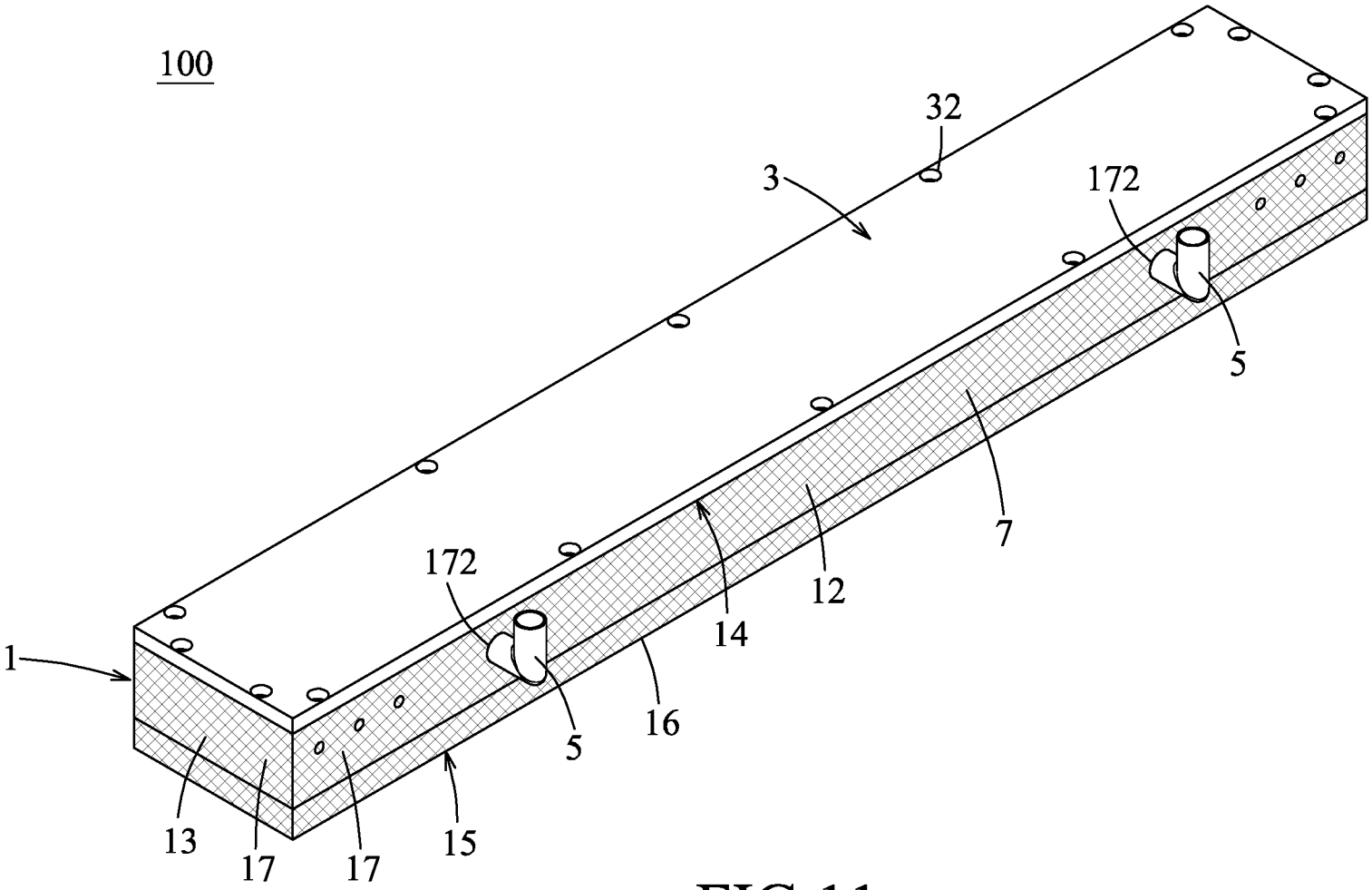
FIG. 11 is a perspective view illustrating execution of step S6 of the embodiment in FIG. 5A.

Referring further to FIG. 11, in executing step S6, the gas fittings 5 are respectively connected to the inlet openings 172 of the frame 1. Since the inlet openings 172 are formed at the frame 1 in this embodiment, portions of the first covering layer 7 that respectively cover the inlet openings 172 are removed right before step S6 to thereby allow the connection. However, for certain embodiments in which the inlet openings 172 are formed at the cover 3, the removal is not required because the first covering layer 7 does not cover the inlet openings 172. After the gas fittings 5 are respectively connected to the inlet openings 172, the cover 3 and the first connecting section 14 of the frame 1 may be temporarily assembled, and compressed dry air may be provided into the inner space 11 of the frame 1 through the gas fittings 5 to conduct an air tightness testing of the connection between the frame 1 and the air-permeable plate 2.

Figure 12:
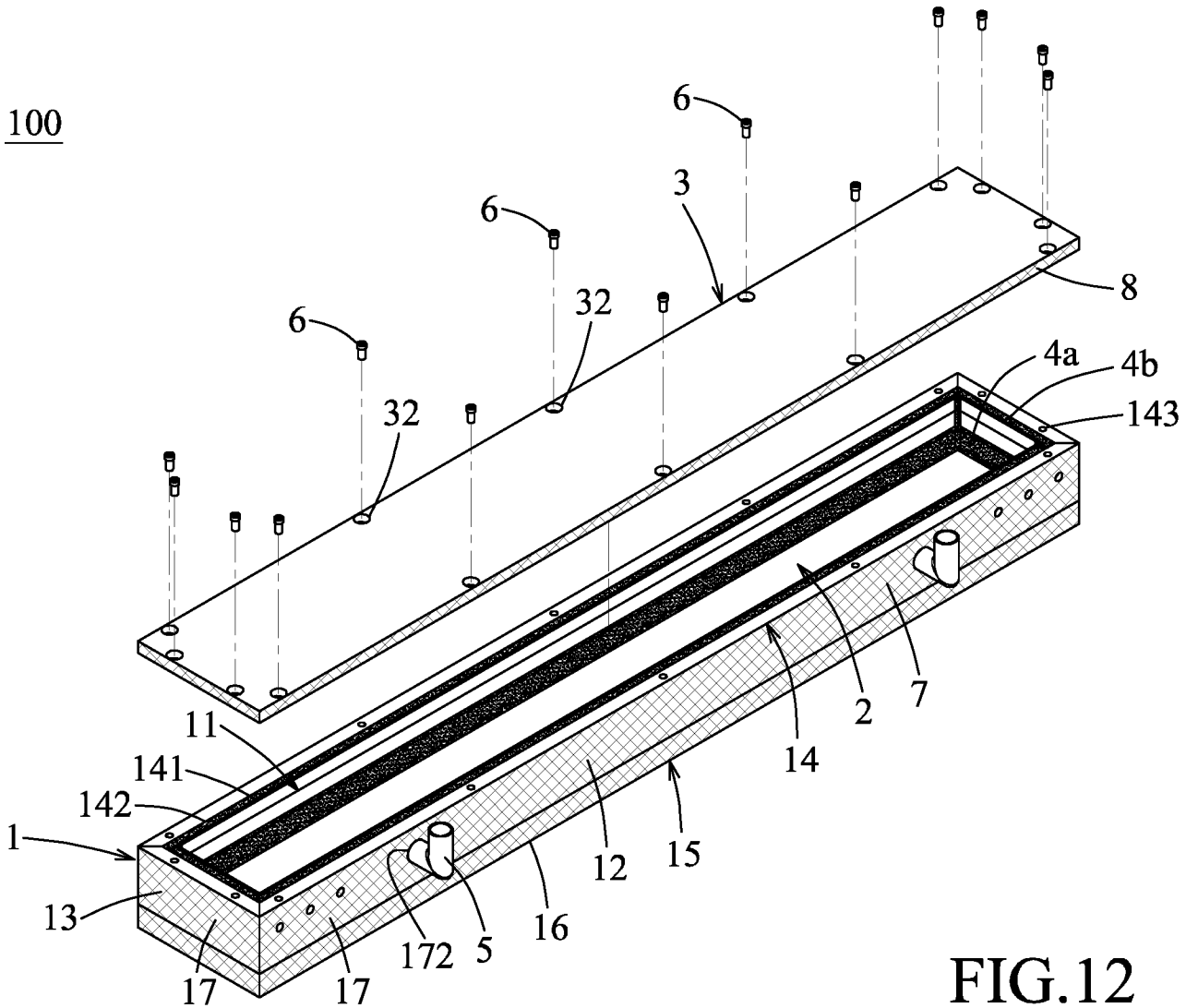
FIG. 12 is a partly exploded perspective view illustrating execution of step S7 of the embodiment in FIGS. 5A and 5B.
Figure 13:
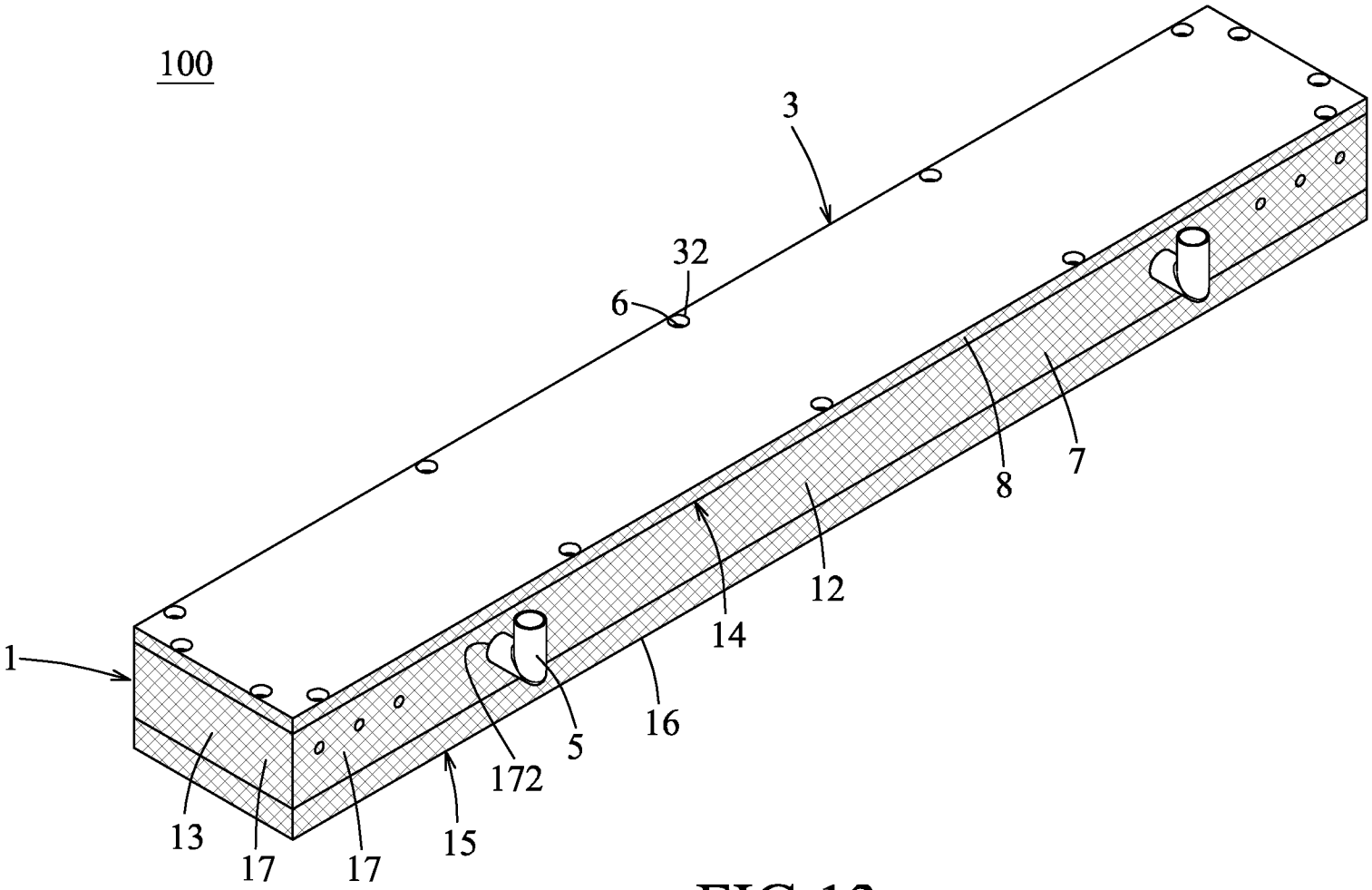
FIG. 13 is a perspective view illustrating the execution of step S7 of the embodiment in FIGS. 5A and 5B.

Referring further to FIGS. 12 and 13, in executing step S7, the cover 3 is sealingly connected to the first connecting section 14 of the frame 1 to close the upper opening 141 of the frame 1. Specifically, step S7 includes sub-steps S71 to S74 (see FIG. 5B). In executing sub-step S71, the second adhesive 4*b* is applied to the groove 142 of the first connecting section 14. It is noted that, in one embodiment, the second adhesive 4*b* may be flush with the upper surface of the first connecting section 14. In executing sub-step S72, the lateral surrounding surface of the cover 3 is covered with the second covering layer 8. Then, in executing sub-step S73, the annular protrusion 31 of the cover 3 and the groove 142 of the first connecting section 14 are coupled (see FIG. 4). Afterwards, the cover 3 is fastened to the first connecting section 14 by the screwing members 6 so that the cover 3 and the first connecting section 14 are sealingly connected by the adhesive 4 and the upper opening 141 of the frame 1 is closed.

Figure 14:
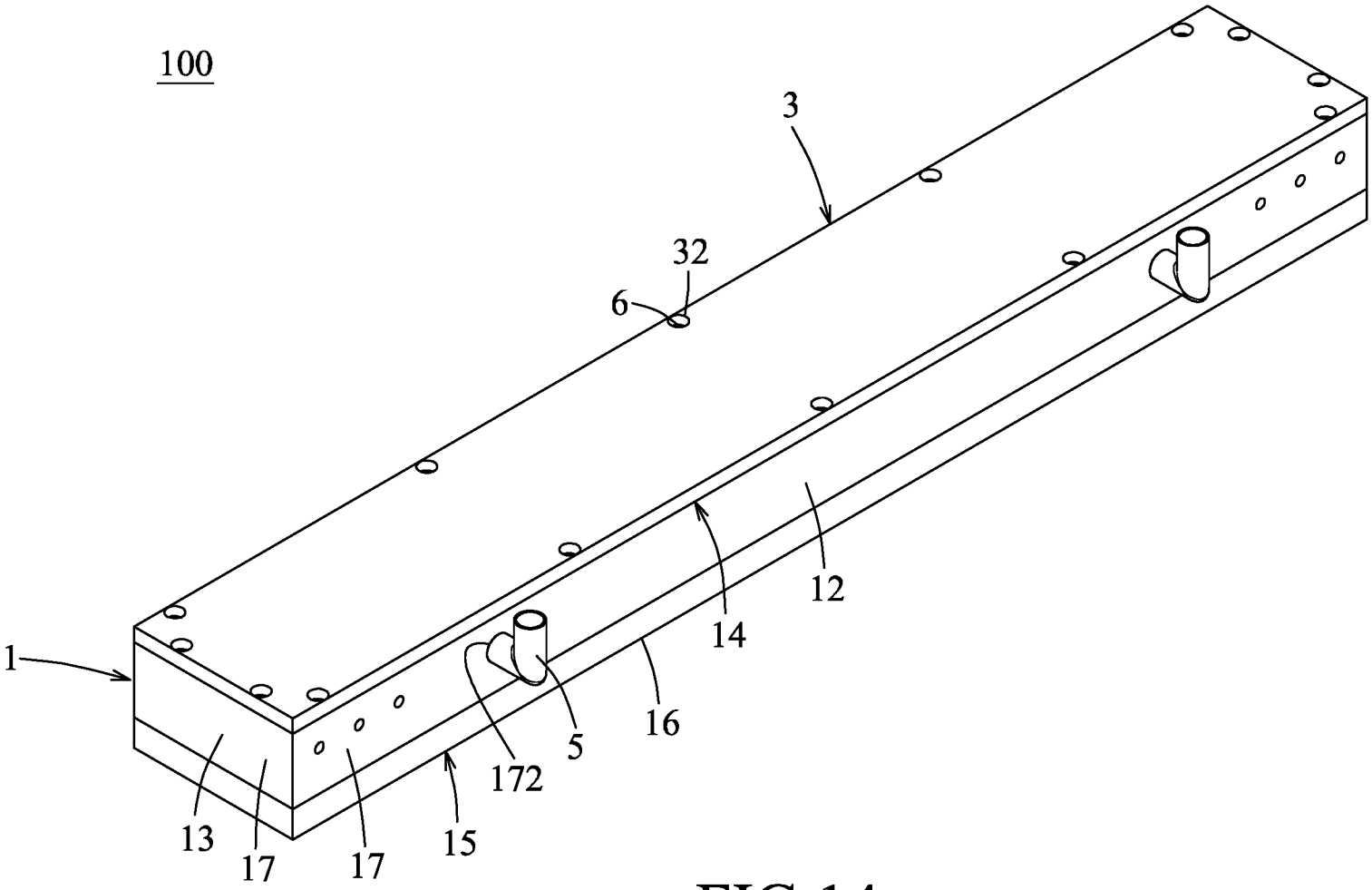
FIG. 14 is a perspective view illustrating execution of step S8 of the embodiment in FIG. 5A.

Referring further to FIG. 14, in executing step S8, the second covering layer 8 that covers the cover 3, and the remaining portion of the first covering layer 7 that covers the lateral outer surface of each of the side wall bodies 12 and the end wall bodies 13 are removed. After that, the air curtain device 100 may be cleaned and then may be ready for product inspection.

In summary, by virtue of the first covering layer 7 covering the upper surface and the lateral outer surface of each of the side wall bodies 12 and the end wall bodies 13, and the groove 142 of the first connecting section 14 of the frame 1, and by virtue of the second covering layer 8 covering the lateral surrounding surface of the cover 3, when the first adhesive 4*a* and the second adhesive 4*b* are accidentally over-applied, the excess first adhesive 4*a* and the excess second adhesive 4*b* are prevented from coming out to the upper surfaces and the lateral outer surfaces of the side wall bodies 12 and the end wall bodies 13 and to the lateral surrounding surface of the cover 3. Therefore, an appearance of the air curtain device 100 is not affected by the application of the first adhesive 4*a* and the second adhesive 4*b*, and step S7 in which the cover 3 is sealingly connected to the frame 1 may be well-executed. Moreover, by virtue of the base frame member 16 and the plate members 17 cooperatively forming the frame 1, the strength of the structure of the air curtain device 100 is reinforced, and air leakage through the frame 1 is prevented.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An air curtain device comprising:

a frame including two side wall bodies that are spaced apart from each other, two end wall bodies that interconnect said side wall bodies, and that cooperate with said side wall bodies to define an inner space thereamong, upper edges of said side wall bodies and said end wall bodies cooperatively forming a first connecting section, lower edges of said side wall bodies and said end wall bodies cooperatively forming a second connecting section, said first connecting section and said second connecting section respectively defining an upper opening and a lower opening through which said inner space communicates with the external environment, wherein said frame is formed by a base frame member that has a base protruding part surrounding said inner space and protruding upwardly and a plurality of plate members each of which is indented with a base-connecting recess, is located over said base frame member, and is coupled to said base protruding part by said base-connecting recess thereof, wherein said base frame member and said plate members cooperatively define said side wall bodies and said end wall bodies;

an air-permeable plate abutting against a surface of said second connecting section of said frame that faces said inner space and closing said lower opening, said air-permeable plate having a plurality of pores to thereby be air permeable;

a cover sealingly connected to said first connecting section of said frame to thereby close said upper opening of said frame, one of said frame and said cover being formed with at least one inlet opening through which said inner space of said frame communicates with the external environment;

a first adhesive applied to a gap between said air-permeable plate and said second connecting section of said frame, to a junction between said base frame member and each of said plate members, and to a junction between any adjacent ones of said plate members; and at least one gas fitting connected to said at least one inlet opening of the one of said frame and said cover.

2. The air curtain device as claimed in claim 1, wherein:

said air curtain device further comprises a second adhesive;

said first connecting section of said frame is indented with a groove surrounding said upper opening and applied with said second adhesive, and is formed with a plurality of threaded holes;

said cover has an annular protrusion protruding from a bottom surface thereof and coupled to said groove, and is formed with a plurality of through holes 10 respectively corresponding in position to said threaded holes; and said air curtain device further comprises a plurality of screwing members respectively extending through said through holes, and respectively and threadedly engaging said threaded holes, so that said cover and said first connecting section are sealingly connected by said second adhesive and said upper opening of said frame is closed.

* * * * *